US006695010B2

(12) United States Patent
Robison et al.

(10) Patent No.: US 6,695,010 B2
(45) Date of Patent: Feb. 24, 2004

(54) SEGMENTED CERAMIC CHOKE

(75) Inventors: Jeffrey C. Robison, Provo, UT (US); Stephen R. Chipman, Provo, UT (US); Michael R. Luque, Orem, UT (US); Craig C. Smith, Provo, UT (US)

(73) Assignee: Caldera Engineering LC, Provo, UT (US)

( * ) Notice: Subject to any disclaimer, the term of this patent is extended or adjusted under 35 U.S.C. 154(b) by 0 days.

(21) Appl. No.: 09/728,001

(22) Filed: Dec. 1, 2000

(65) Prior Publication Data

US 2001/0029988 A1 Oct. 18, 2001

Related U.S. Application Data

(60) Provisional application No. 60/168,996, filed on Dec. 2, 1999.

(51) Int. Cl.[7] ..... F15D 1/02
(52) U.S. Cl. ..... 138/39; 138/44
(58) Field of Search ..... 138/44, 39, 38

(56) References Cited

U.S. PATENT DOCUMENTS 2,687,147 A * 8/1954 Feichter ..... 138/44
3,687,493 A * 8/1972 Lock et al. ..... 138/44
4,023,508 A * 5/1977 Cantrell et al. ..... 110/212
4,102,632 A * 7/1978 Hastings ..... 138/38
4,644,974 A * 2/1987 Zingg ..... 138/44
4,774,914 A 10/1988 Ward ..... 123/162
4,878,925 A * 11/1989 Kojima ..... 138/38
4,951,929 A * 8/1990 Schwarz et al. ..... 428/34.6
5,104,233 A * 4/1992 Kojima ..... 366/339
5,246,074 A 9/1993 Ayres ..... 166/310
5,260,116 A * 11/1993 Hamanaka et al. ..... 428/172
5,511,585 A * 4/1996 Lee, II ..... 138/44
5,827,582 A * 10/1998 Quadir et al. ..... 428/34.4
6,110,255 A * 8/2000 Williams et al. ..... 75/744

* cited by examiner

*Primary Examiner*—James Hook
(74) *Attorney, Agent, or Firm*—Lloyd W. Sadler

(57) ABSTRACT

A new segmented choke is provided. Designed to reduce thermal stresses created when the fluid temperature fluctuate, this invention is constructed of segmented ceramic members fit within a relatively thin-walled retainer, shrunk fit thereto, thereby allowing the retainer to be more compliant. Shorter, multiple segments used in this invention are also easier to manufacture, can be produced with tighter tolerances, provide easier access thereby reducing maintenance costs and allow for the inclusion of sensors in the individual ceramic segments. This invention also provides improvements in size, manufacturing cost, ease of use and operating efficiency over prior choke devices.

3 Claims, 10 Drawing Sheets

SEGMENTED CERAMIC CHOKE

This application claims the benefit of provisional application No. 60/168,996 filed on Dec. 2, 1999.

BACKGROUND OF THE INVENTION

1. Field of the Invention

This invention relates to devices for choking a fluid flow path. More specifically, this invention relates to ceramic choke designs that have multiple sections of ceramic with retaining mounts shrunk fit around them, which in turn are mounted into a housing.

2. Description of Related Art

A variety of choke devices have been used for some time in the control of fluid through a conduit. Typically, these prior devices consist of one large piece of ceramic, with a one piece housing that is shrunk to fit over the ceramic, thereby making a tight fit when cooled. The housing is typically composed of titanium. For general background material, the reader is directed to U.S. Pat. Nos. 4,774,914 and 5,246,074 each of which is hereby incorporated by references in its entirety for the material contained therein.

SUMMARY OF THE INVENTION

It is desirable to provide a choke device for controlling the flow of fluid through a conduit. In particular, it is desirable to provide a choke design, which reduces thermal stresses. Moreover, it is desirable to provide a choke design that facilitates the use of sensors within the choke. It is also desirable to provide a choke design with improved manufacturability and maintenance.

Therefore, it is the general object of this invention to provide a choke device that has a retainer and sleeve walls with smaller overall wall thickness, which reduces the thermal stresses created when the fluid temperature fluctuates.

It is a further object of this invention to provide a choke device that uses a plurality of ceramic segments, each of which fits into a relatively thin walled retainer, thereby allowing the retainer to be more complaint.

It is another object of this invention to provide a choke device that provides reduced stress variations associated with variances in choke clearances.

Another object of this invention is to provide a choke device that uses a ductile retainer thereby providing the ability to withstand additional fluctuations in stress than is possible with brittle ceramic alone.

A further object of this invention is to provide a choke device, which uses shorter segments that are easier to construct, and which can be produced with tighter tolerances.

A still further object of this invention is to provide a choke device, which can more easily be assembled by shrink fitting with the retainers.

Another object of this invention is to provide a choke device which has segmented members that can be replaced individually, allowing for reductions in maintenance costs.

It is another object of this invention to provide a choke device that more accurately controls compressive stresses during construction of the choke.

It is a further object of this invention to provide a choke device that accommodates the inclusion of sensors into individual segments of the choke, allowing for indicators of choke segment integrity without disassembly of the choke and taking it out of service.

These and other objects of this invention are achieved by the device described herein and are readily apparent to those of ordinary skill in the art upon review of this disclosure and/or ordinary experimentation with the device described herein.

DETAILED DESCRIPTION OF THE INVENTION

Figure 1:
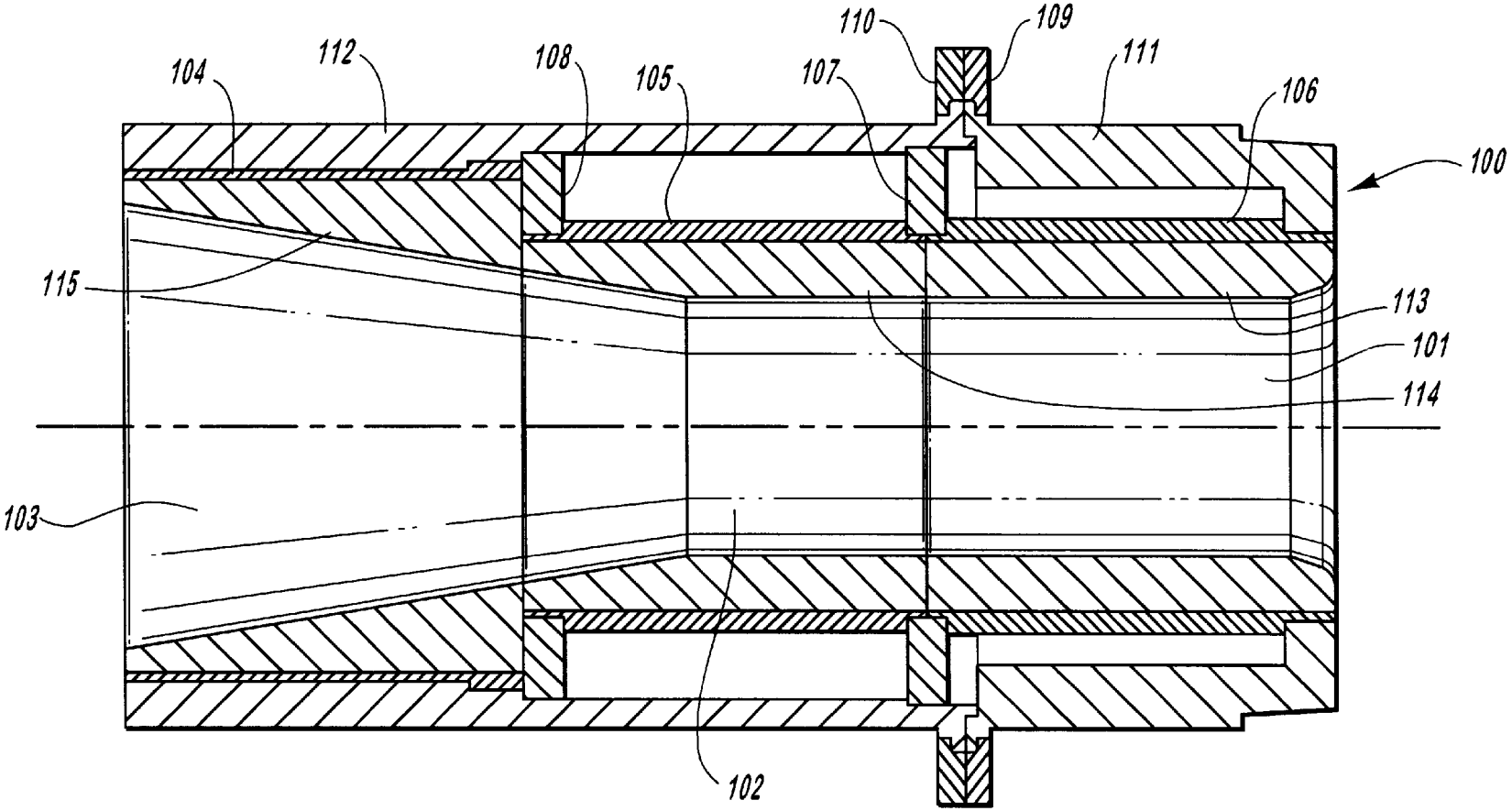
FIG. 1 is a section view of the preferred segmented choke of this invention.

Referring now to the figures and particularly to FIG. 1, which is a section view of the preferred embodiment 100 of the segmented choke of this invention. In this embodiment three ceramic sections 101, 102, 103 are provided within a retainer fixtures 104, 105, 106. The first ceramic section 101, containing a sleeve 200 and a first ceramic region 113, is held in place by the first retainer 106. The second ceramic section 102, containing a sleeve 300 and a second ceramic region 114, is held in place by the second retainer 105. The third ceramic section 103, containing a sleeve 400 and a third ceramic region 115, is held in place by the third retainer 104. Each ceramic section 101, 102, 103 is shrunk fit into its retainer fixture 104, 105, 106. The retainer fixtures 104, 105, 106 are then mechanically mounted into a housing, which is composed of two parts an upper housing 111 and a lower housing 112. The first 106 and second 105 retainer fixtures are held together by an upper mount 107. The second 105 and third 104 retainer fixtures are held together by a lower mount 108. The upper housing 111 and the lower housing 112 are held together by two flange rings 109, 110.

Figure 2B:
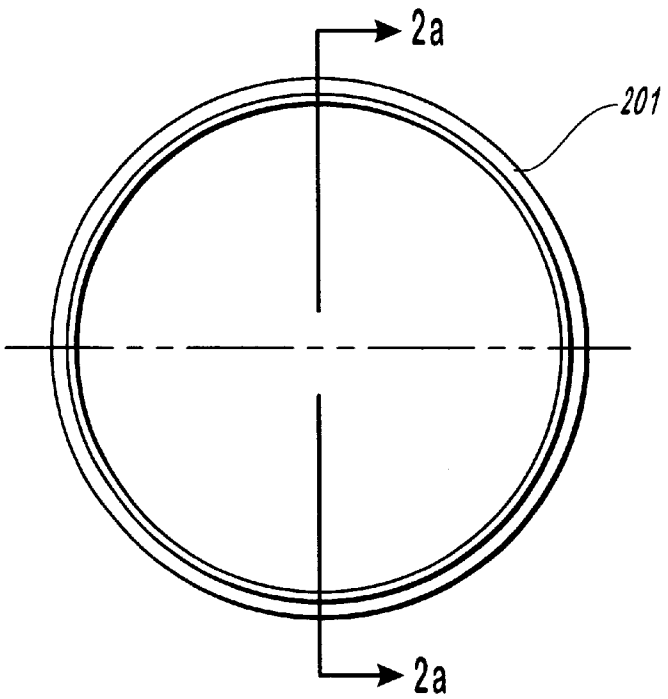
FIGS. 2*a* and 2*b* are detailed section and end views of the sleeve of the first segment of the preferred segmented choke of this invention.
Figure 2A:
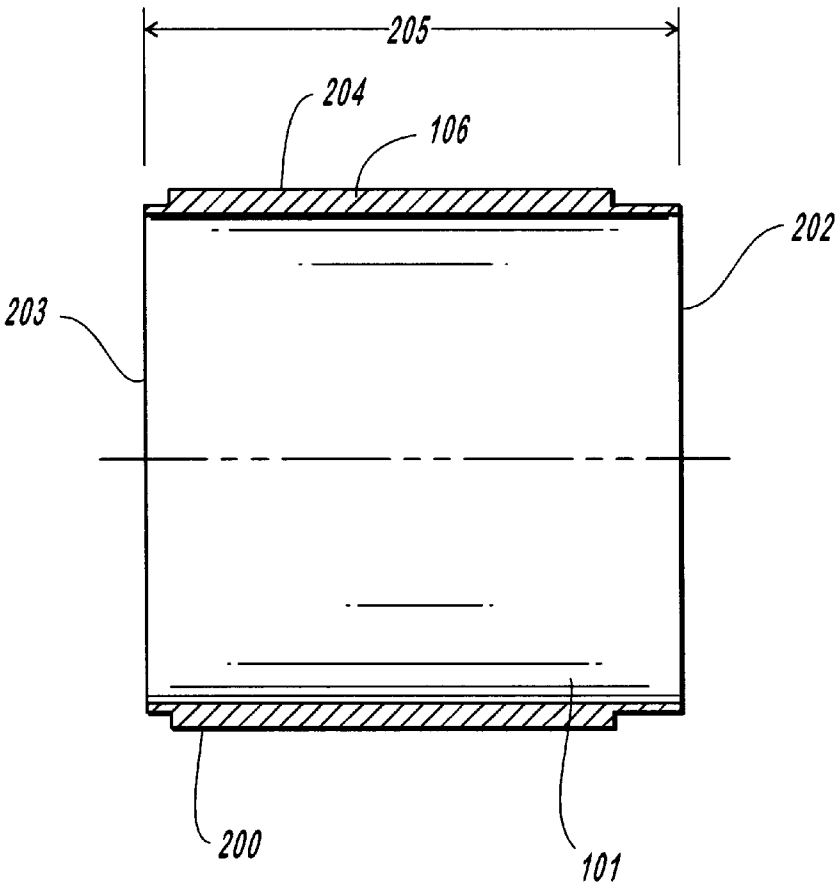

FIG. 2*a*, a section view of the sleeve 200 of the first ceramic section 101 and associated retainer 106, provides additional dimensional detail of the preferred embodiment of this invention. This sleeve 200 has a first end 202 and a second end 203. In the preferred embodiment, the first end 202 has an inner diameter of 6.50 inches and an outer diameter of 6.750 inches. The second end 203 has an outer diameter of 7.250 inches. The length 205 of the side 204 of this preferred embodiment is 7.330 inches. FIG. 2*b* shows the end view of the sleeve 200 of the first ceramic section 101 and retainer 106. The ceramic section 101 is adapted to permit the inclusion of a sensor for making a variety of flow rate, temperature, pressure and content measurements.

Figure 3B:
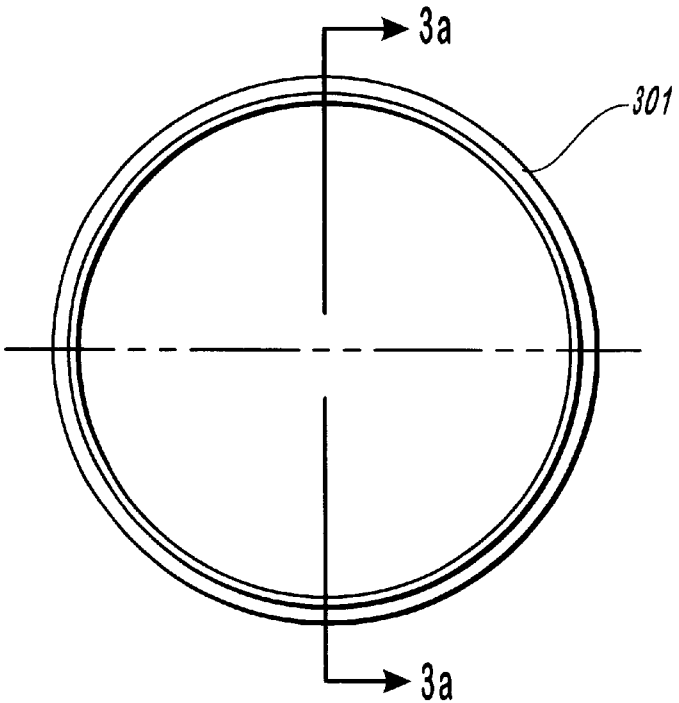
FIGS. 3*a* and 3*b* are detailed section and end views of the sleeve of the second segment of the preferred segmented choke of this invention.
Figure 3A:
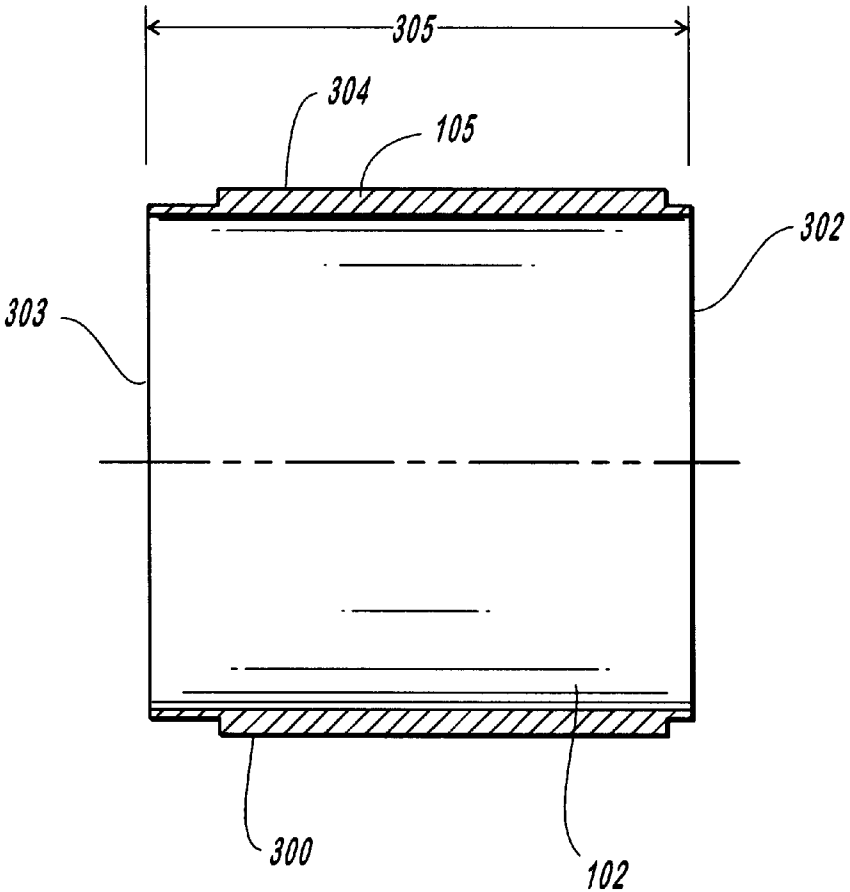

FIG. 3*a*, a section view of the sleeve 300 of the second ceramic section 102 and associated retainer 105, provides additional dimensional detail of the preferred embodiment of this invention. This sleeve 300 has a first end 302 and a second end 303. In the preferred embodiment, the first end 302 has an inner diameter of 6.50 inches and an outer diameter of 6.750 inches. The second end 303 has an outer diameter of 7.250 inches. The length 305 of the side 304 of this preferred embodiment is 7.330 inches. FIG. 3*b* shows the end view of the sleeve 300 of the second ceramic section 102 and retainer 105. This ceramic section 102 is also adapted to permit the inclusion of a sensor for making a variety of flow rate, temperature, pressure and content measurements.

Figure 4B:
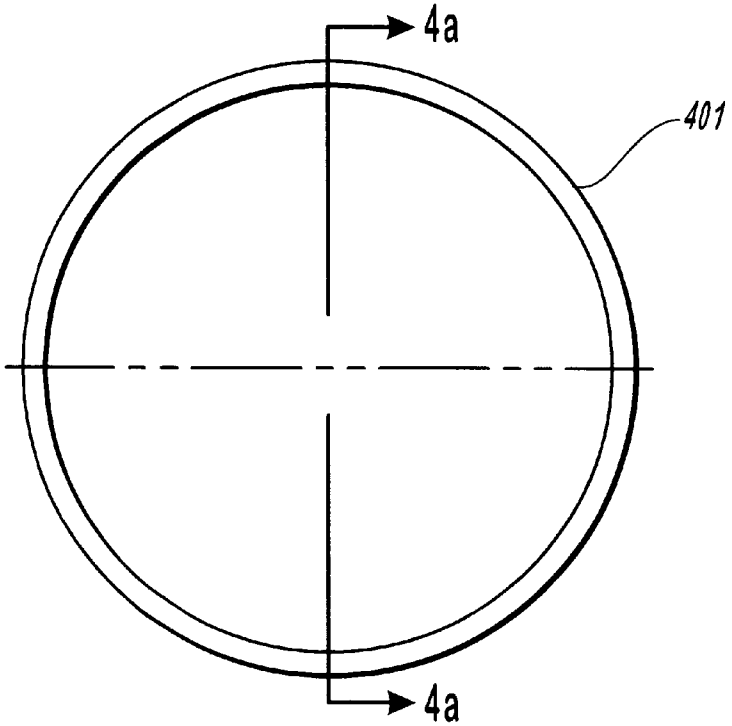
FIGS. 4*a* and 4*b* are detailed section and end views of the sleeve of the third segment of the preferred segmented choke of this invention.
Figure 4A:
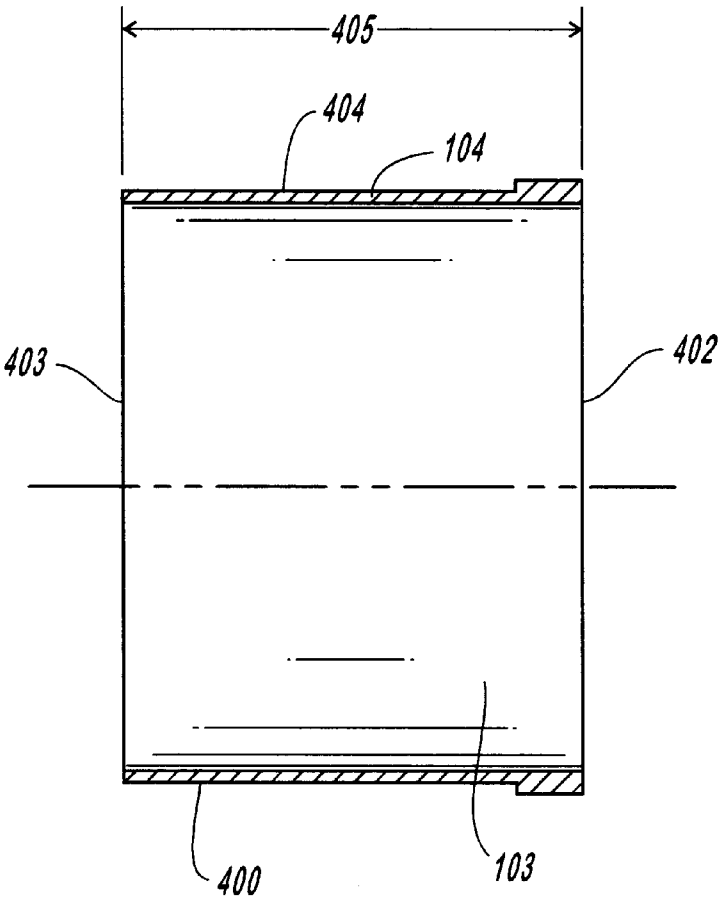

FIG. 4*a*, a section view of the sleeve 400 of the third ceramic section 103 and associated retainer 104, provides additional dimensional detail of the preferred embodiment of this invention. This sleeve 400 has a first end 402 and a second end 403. In the preferred embodiment, the first end 402 has an inner diameter of 8.80 inches and an outer diameter of 9.50 inches. The second end 403 has an outer diameter of 9.180 inches. FIG. 4*b* shows the end view of the sleeve 400 of the third ceramic section 103 and retainer 104. This ceramic section 103 is also adapted to permit the inclusion of a sensor for making a variety of flow rate, temperature, pressure and content measurements.

Figure 5B:
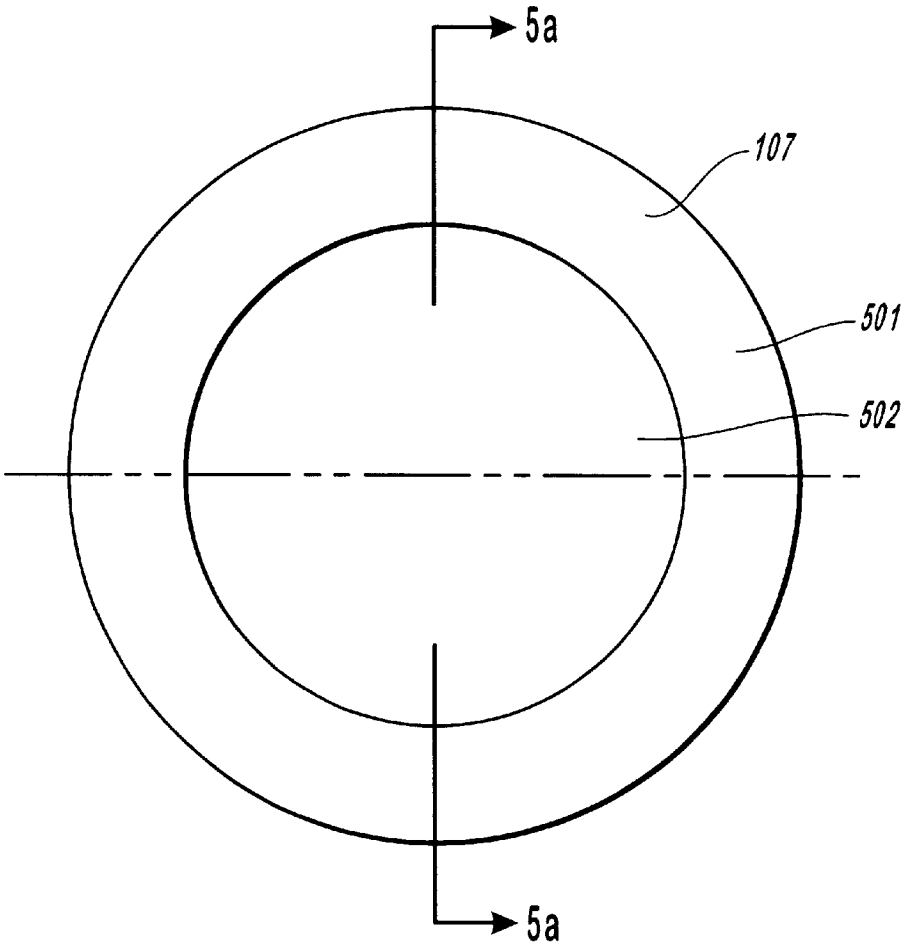
FIGS. 5*a* and 5*b* are detailed section and end views of the upper inner ring of the preferred choke of this invention.
Figure 5A:
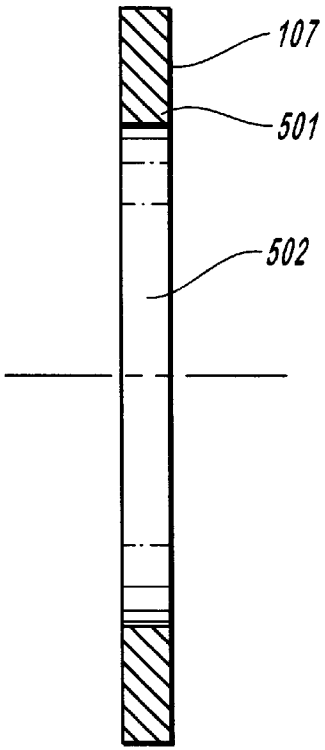

FIG. 5*a*, a section view of the upper inner ring 107, provides additional dimensional detail of the preferred embodiment of this invention. The preferred embodiment of this upper inner ring 107 has an outer diameter of 9.910 inches and an inner opening 502 diameter of 6.760 inches. The preferred ring 501 is composed of titanium. FIG. 5*b* shows the end view of the upper inner ring 107.

Figure 6B:
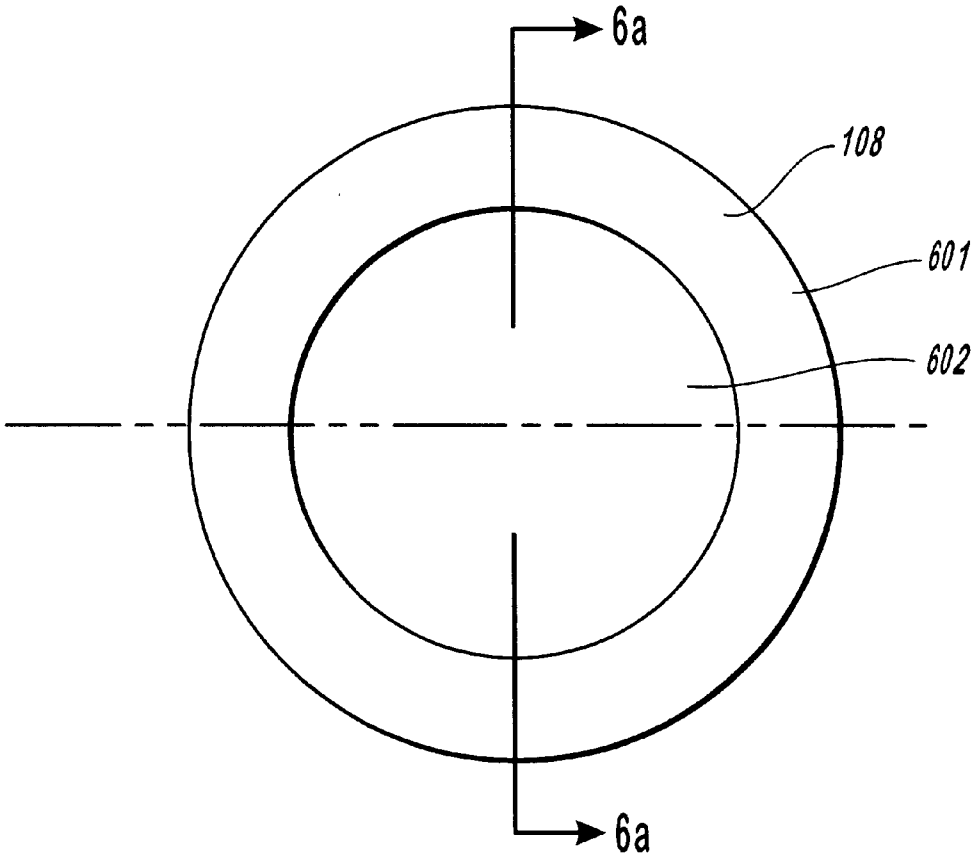
FIGS. 6*a* and 6*b* are detailed section and end views of the lower inner ring of the preferred choke of this invention.
Figure 6A:
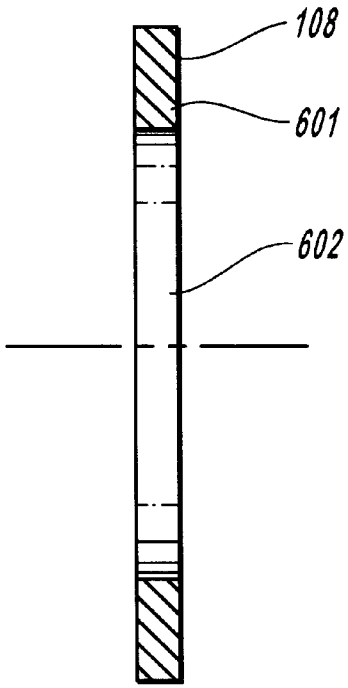

FIG. 6*a*, a section view of the lower inner ring 108, provides additional dimensional detail of the preferred embodiment of this invention. The preferred embodiment of this lower inner ring 108 has an outer diameter of 9.740 inches and an inner opening 602 of 6.760 inches. The preferred ring 601 is composed of titanium. FIG. 6*b* shows the end view of the lower inner ring 108.

Figure 7B:
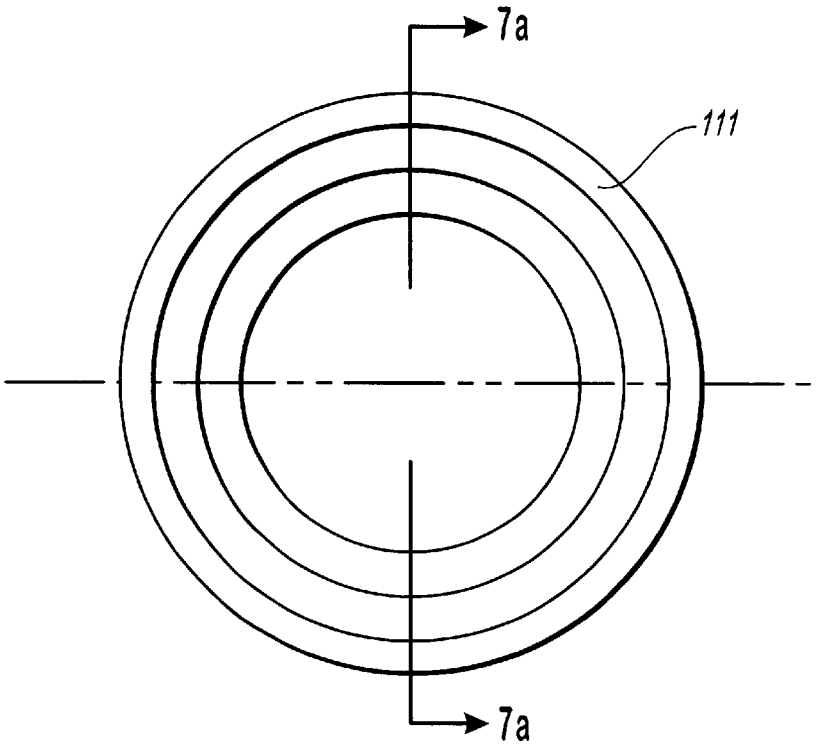
FIGS. 7*a* and 7*b* are detailed section and end views of the first housing section of the preferred choke of this invention.
Figure 7A:
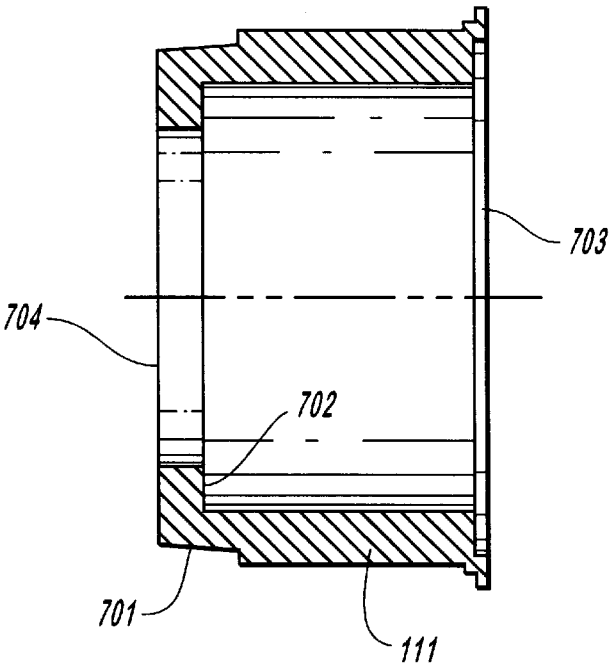

FIG. 7*a*, a section view of the first housing section 111, provides additional dimensional detail of the preferred embodiment of this invention. This housing 111 has a first end 703 and a second end 704. The preferred dimensions of this housing section 111 are shown in inches in this FIG. 7*a*. A first gasket surface 701 and a second gasket surface 702 are provided. In its preferred embodiment the first housing section 111 is composed of titanium. FIG. 7*b* shows the end view of the first housing section 111.

Figure 8B:
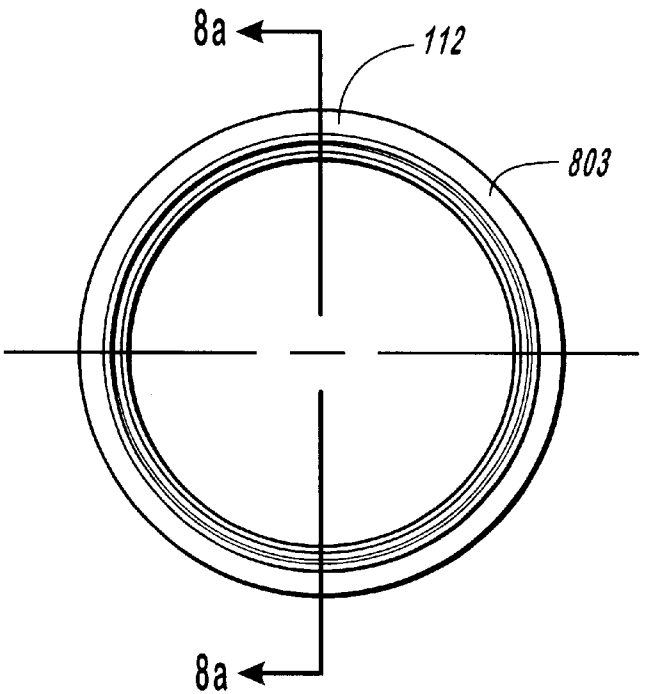
FIGS. 8*a* and 8*b* are detailed section and end views of the second housing section of the preferred choke of this invention.
Figure 8A:
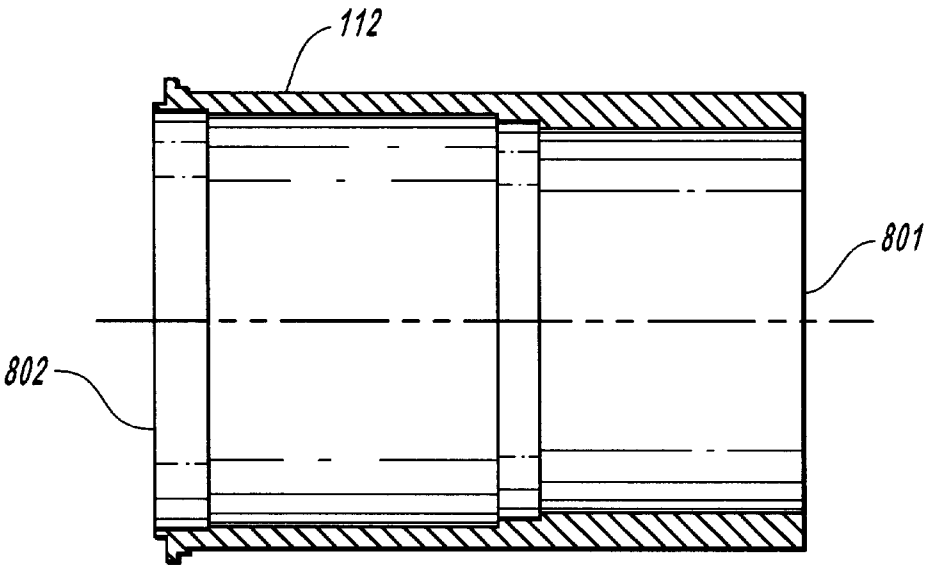

FIG. 8*a*, a section view of the second housing section 112, provides additional dimensional detail of the preferred embodiment of this invention. This housing 112 has a first end 801 and a second end 802. The preferred dimensions of this housing section 112 are shown in inches in this FIG. 8*a*. In its preferred embodiment the first housing section 112 is composed of titanium. FIG. 8*b* shows the end view of the second housing section 112 and retainer 106.

Figure 9B:
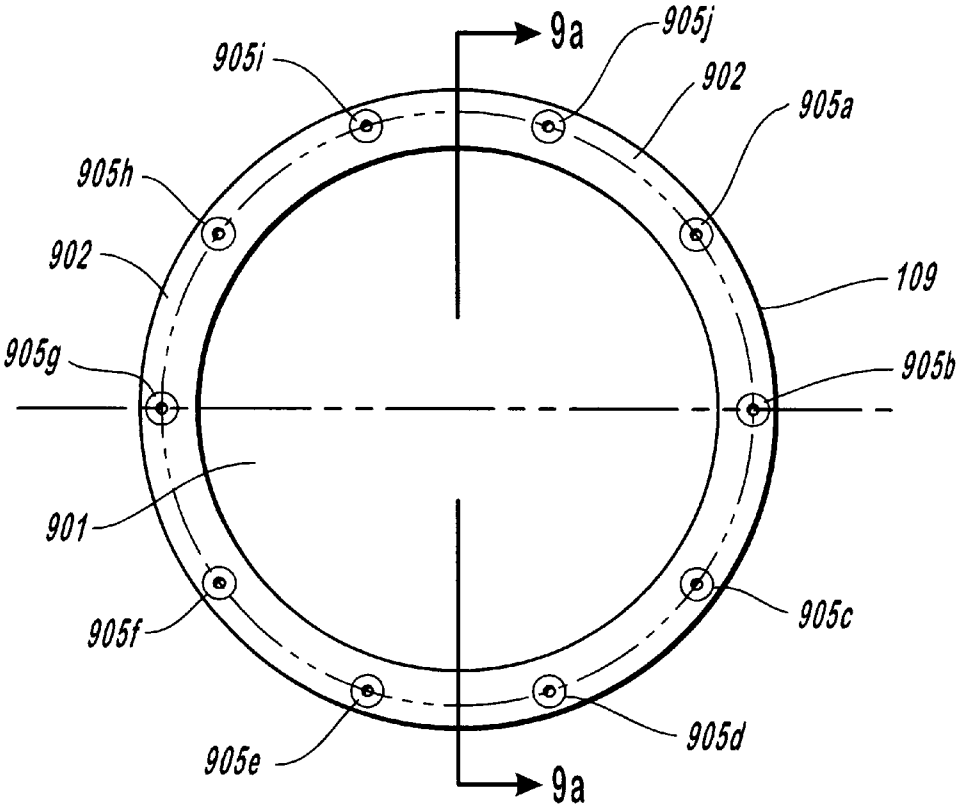
FIGS. 9*a* and 9*b* are detailed section and end views of upper flange ring of the preferred choke of this invention.
Figure 9A:
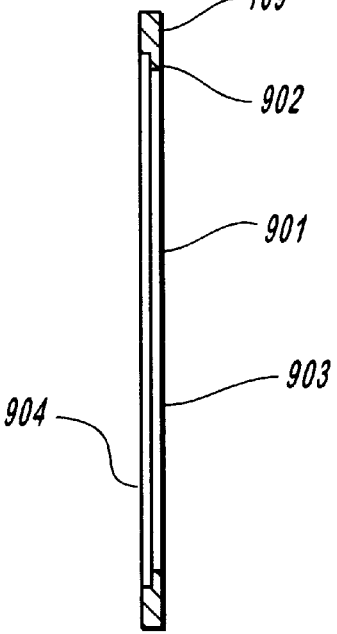

FIG. 9*a*, a section view of the upper flange ring 109, provides additional dimensional detail of the preferred embodiment of this invention. This flange ring 109 has a first end 903 and a second end 904. A ring 902 is provided with a plurality of openings 905*a–j*, each of which is adapted to receive and accommodate bolt and nut fasteners. Alternative fasteners, such as rivets, screws and the like can be substituted without departing from the concept of this invention. The preferred material for the ring 109 is titanium. The preferred dimensions of this flange ring 109 are shown in inches in this FIG. 9*a*. FIG. 9*b* shows the end view of the upper flange ring 109.

Figure 10B:
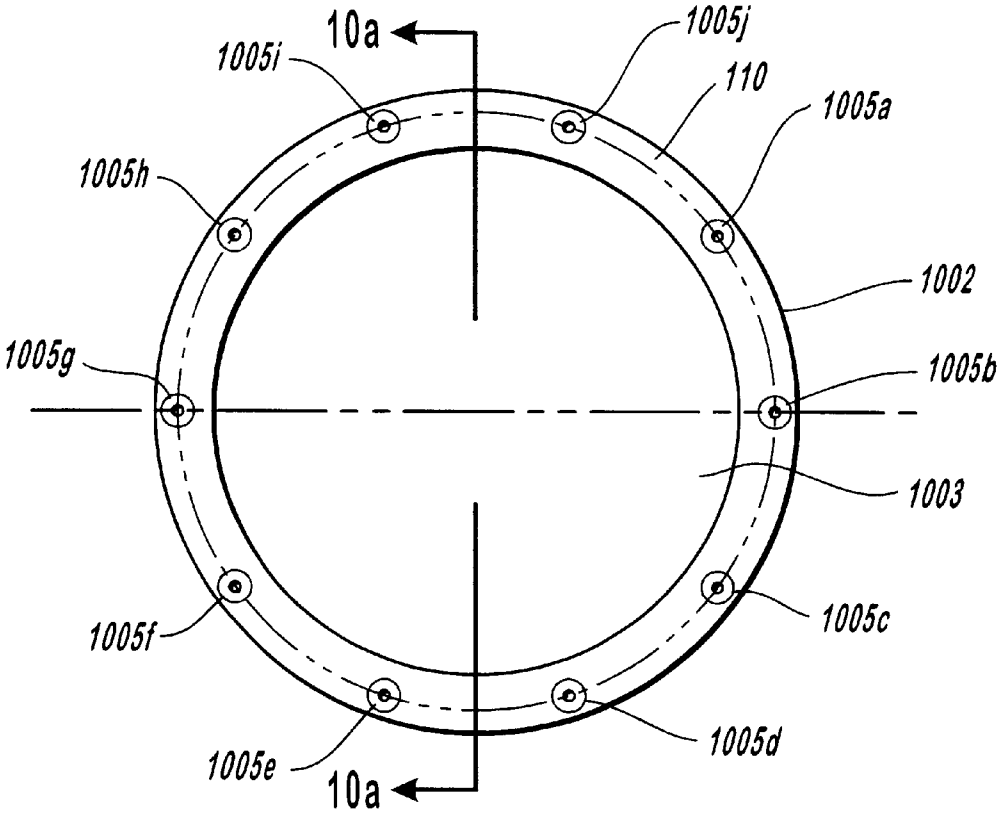
FIGS. 10*a* and 10*b* are detailed section and end views of the lower flange ring of the preferred choke of this invention.
Figure 10A:
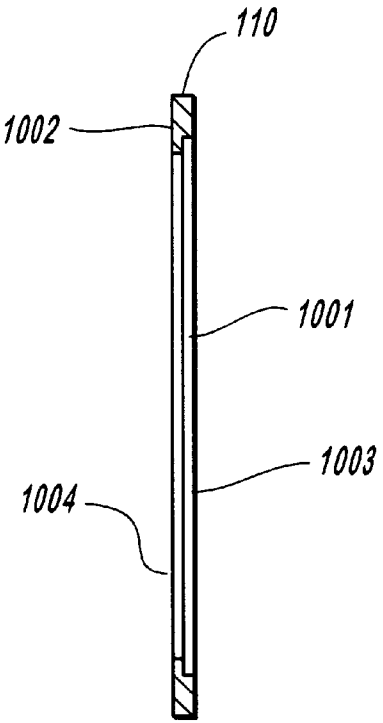

FIG. 10*a*, a section view of the lower flange ring 110, provides additional dimensional detail of the preferred embodiment of this invention. This flange ring 110 has a first end 1003 and a second end 1004. The ring 1002 is provided with a plurality of openings 1005*a–j*, each of which is adapted to receive and accommodate bolt and nut fasteners. Alternative fasteners, such as rivets, screws and the like can be substituted without departing from the concept of this invention. The preferred material for the ring 110 is titanium. The preferred dimensions of this flange ring 110 are shown in inches in this FIG. 10*a*. FIG. 10*b* shows the end view of the lower flange ring 110.

It is to be understood that the above-described embodiment of the invention is merely illustrative of numerous and varied other embodiments, which may constitute applications of the principles of the invention. Such other embodiments may be readily devised by those skilled in the art without departing from the spirit or scope of this invention and it is our intent that they are deemed as within the scope of our invention.

We claim:

1. A segmented choke apparatus, comprising:

(A) a housing;

(B) a retainer held within said housing by an inner ring;

(C) a first ceramic section shrunk fit within said retainer, said first ceramic section having a cylindrical shape;

(D) a second ceramic section shrunk fit within said retainer, said second ceramic section having a first portion with a cylindrical shape and a second portion with a truncated conical shape; and (E) a third ceramic section shrunk fit within said retainer, said third ceramic section having a truncated conical shape.

2. A segmented choke apparatus, comprising:

(A) a housing composed of titanium;

(B) a retainer held within said housing, by an inner ring, said retainer composed of titanium; and (C) a first ceramic section shrunk fit within said retainer, said first ceramic section having a cylindrical shape;

(D) a second ceramic section shrunk fit within said retainer having a cylindrical portion adapted to fit adjacent to said first ceramic section and a truncated conical portion; and (E) a third ceramic section shrunk fit within said retainer, said third ceramic section having a truncated conical shape and where in said third ceramic section is adapted to fit adjacent to said second ceramic section.

3. A segmented choke apparatus, comprising:

(A) a housing, further comprising an upper housing and a lower housing;

(B) a first retainer composed of titanium mechanically held within said upper housing by an upper inner ring;

(C) a second retainer composed of titanium mechanically held within said lower housing by a lower inner ring;

(D) a third retainer composed of titanium mechanical held within said lower housing by said lower inner ring;

(E) a first ceramic section shrunk fit within said first retainer, said first ceramic section having a cylindrical shape;

(F) a second ceramic section shrunk fit within said second retainer, said second ceramic section having a cylindrical portion adapted to fit adjacent to said first ceramic section and a truncated conical portion; and (G) a third ceramic section shrunk fit within said third retainer, said third ceramic section having a truncated conical shape and being adapted to fit adjacent to said conical portion of said second ceramic section.

* * * * *